US006210264B1

(12) United States Patent
Richardson

(10) Patent No.: US 6,210,264 B1
(45) Date of Patent: Apr. 3, 2001

(54) COIN DISPENSING APPARATUS

(75) Inventor: William Phillip Richardson, Ashton-under-Lyme (GB)

(73) Assignee: Coin Controls, Limited, Lancashire (GB)

( * ) Notice: Subject to any disclaimer, the term of this patent is extended or adjusted under 35 U.S.C. 154(b) by 0 days.

(21) Appl. No.: 09/194,427

(22) PCT Filed: May 22, 1997

(86) PCT No.: PCT/GB97/01399

§ 371 Date: Feb. 25, 1999

§ 102(e) Date: Feb. 25, 1999

(87) PCT Pub. No.: WO97/45811

PCT Pub. Date: Dec. 4, 1997

(30) Foreign Application Priority Data

May 29, 1996 (GB) ..... 9611174

(51) Int. Cl.[7] ..... G07D 1/00
(52) U.S. Cl. ..... 453/57
(58) Field of Search ..... 453/13, 33, 49, 453/57

(56) References Cited

U.S. PATENT DOCUMENTS 4,257,436 3/1981 Smith ..... 453/41
4,798,558 * 1/1989 Bellis ..... 453/57 X

FOREIGN PATENT DOCUMENTS 43 10 411 A1 10/1993 (DE) .
0 461 889 A2 12/1991 (EP) .
WO 95/05645 2/1995 (WO) .

* cited by examiner

*Primary Examiner*—F. J. Bartuska
(74) *Attorney, Agent, or Firm*—Arent Fox Kintner Plotkin & Kahn

(57) ABSTRACT

Coin dispensing apparatus is provided comprising a bed (13), a coin holder (14) movable relative to the bed (13) and spaced from the bed by a gap, the coin holder having at least one coin reservoir (15) capable of holding a stack of at least two coins with the lowermost coin in contact with the bed, means (18) to eject the lowermost coin from the apparatus through the gap between the bed and the coin holder, and support means (21) to prevent or restrict tilting of the coin above the lowermost coin as the lowermost coin is ejected. The provision of a support means has the advantage that dispensing apparatus can be arranged such that the lowermost coin lies within the said gap to a much greater extent than with prior art devices. This provides greater control over the coin and therefore makes it less critical for the size of the gap to be very closely matched to the thickness of the coin to be handled.

11 Claims, 5 Drawing Sheets

PRIOR ART

COIN DISPENSING APPARATUS

The invention relates to coin dispensing apparatus, being understood that the term coin includes not only monetary units but also similar shaped items such as tokens.

The invention is particularly concerned with the form of coin dispensing apparatus known as a compact hopper. A prior art form of compact hopper is shown in an exploded perspective form in FIG. 1.

The prior art compact hopper comprises a base 10 on which is mounted a dispensing unit 11. A bowl 12 is fitted onto the base to cover the dispensing unit 11.

The unit 11 comprises a static bed 13 on which is mounted a rotary disc 14 having four holes 15 therein. Each hole 15 has a diameter which is greater than the diameter of the coin to be dispensed.

In use the bowl 12 is filled with coins which lie randomly within the bowl. However, as the disc 14 rotates, coins successively fall into the holes 15 and because the disc 14 has a thickness which is equal to the thickness of several coins, a plurality of coins form short stacks within the holes 15, the lowermost coin of each stack abutting the bed 13.

There is a gap between the disc 14 and the bed 13 which is fractionally greater than the thickness of the coin but the lowermost coin of each stack still moves round with the disc 14 because of projections 16 on the disc which protrude below the disc 14.

Adjacent to a dispensing slot 17 one or more spring loaded fingers 18 protrudes from the bed.

The disc rotates anticlockwise as viewed in FIG. 1 and as the lowermost coin of each stack reaches the finger 18 the coin is squeezed between the projection 16 and the fingers 18. Initially the fingers 18 are moved back against the action of its spring, storing energy, but when the coin comes into full registration with the slot 17 the stored energy causes the coin to flip out through the slot and the finger returns to the position shown in FIG. 1, ready to receive the lowermost coin of the next stack.

FIG. 2 is an underplan of the dispensing device and it can be seen that the shaded coin 19 is about to be squeezed between the pushing projection 16 and the spring loaded fingers 18.

The prior art arrangement is fairly tolerant of changes in coin diameter, allowing one disc hole size to be used with a range of coins of different diameters. It can be seen from FIG. 2 that there is quite a difference in size between the diameter of the holes 15 and the diameter of the shaded coin 19. However, the gap between the disc and the bed is critical to a successful operation and must vary depending upon the thickness of the coin. If the gap is too small, coins will not be able to pass between the disc and the bed to the exit slot. If the gap is too large, the leading edge of a coin will be able to lift up and travel over the top of the fingers and the coin will not be ejected.

Each coin has to be allowed to engage partially in this gap, as the coin travels around the bed, to exercise control over the coin to prevent the leading edge from lifting. However the coin must not be allowed to pass too far into the gap otherwise it will not provide support for the coin immediately above. If the coin immediately above is not supported, then that coin will substantially overhang the lowermost coin and tip downwardly. It may therefore jam or it may hit the spring loaded fingers first, causing the spring loaded fingers to be pushed back too far, such that the lowermost coin rides over the fingers and is not dispensed.

Since the lowermost coin can only be allowed to engage partially in the gap as it travels around the bed, it is only the rear edge of the coin which can be controlled. To exercise a sufficient degree of control, the gap must be very closely matched to the thickness of the coin to be handled.

Hence the actual design of each hopper must be adjusted to suit each specific coin geometry.

We have developed an apparatus which is more tolerant to variations in coin thickness, thus allowing a range of coins to be dispensed efficiently and consistently from a single size of hopper.

The invention provides coin dispensing apparatus comprising a bed, a coin holder movable relative to the bed and spaced from the bed by a gap, the coin holder having at least one coin reservoir capable of holding a stack of at least two coins with the lowermost coin in contact with the bed, means to eject the lowermost coin from the apparatus through the gap between the bed and the coin holder, and support means to prevent or restrict tilting of the coin above the lowermost coin, as the lowermost coin is ejected.

Utilising the support means defined above has the advantage that a dispensing apparatus can be arranged such that the lowermost coin lies within the said gap to a much greater extent than with the prior art devices.

This may be brought about by providing a coin pushing device on the rotor which is appropriately spaced from the edge of the associated hole.

Since with the support means according to the invention, the lowermost coin can lie within the gap to a much greater extent, the thickness of the gap can be somewhat larger than the thickness of the coin, while still exerting a significant degree of control over lifting movement of the leading edge of the coin.

The coin holder may comprise a rotor which is rotatably mounted on the bed, the rotor having at least one hole therethrough, which hole acts as the coin reservoir.

The support means to prevent or restrict tilting of the coin above the lowermost coin may comprise a projection at the lower end of the hole.

The projection may comprise a ledge positioned to support the leading edge of the coin above the lowermost coin.

The rotor of the apparatus according to the invention may comprise a disc.

The disc may have a plurality of coin supporting holes therein, for example three or four.

The apparatus may be provided with at least one spring loaded finger against which a coin to be dispensed can be squeezed by the coin pushing member.

Where a plurality of holes is provided, the plurality of associated ledges may be provided by mounting an appropriately shaped member between the bed and the disc.

By way of example a specific embodiment of the invention will now be described, with reference to the accompanying drawings, in which.

Figure 1:
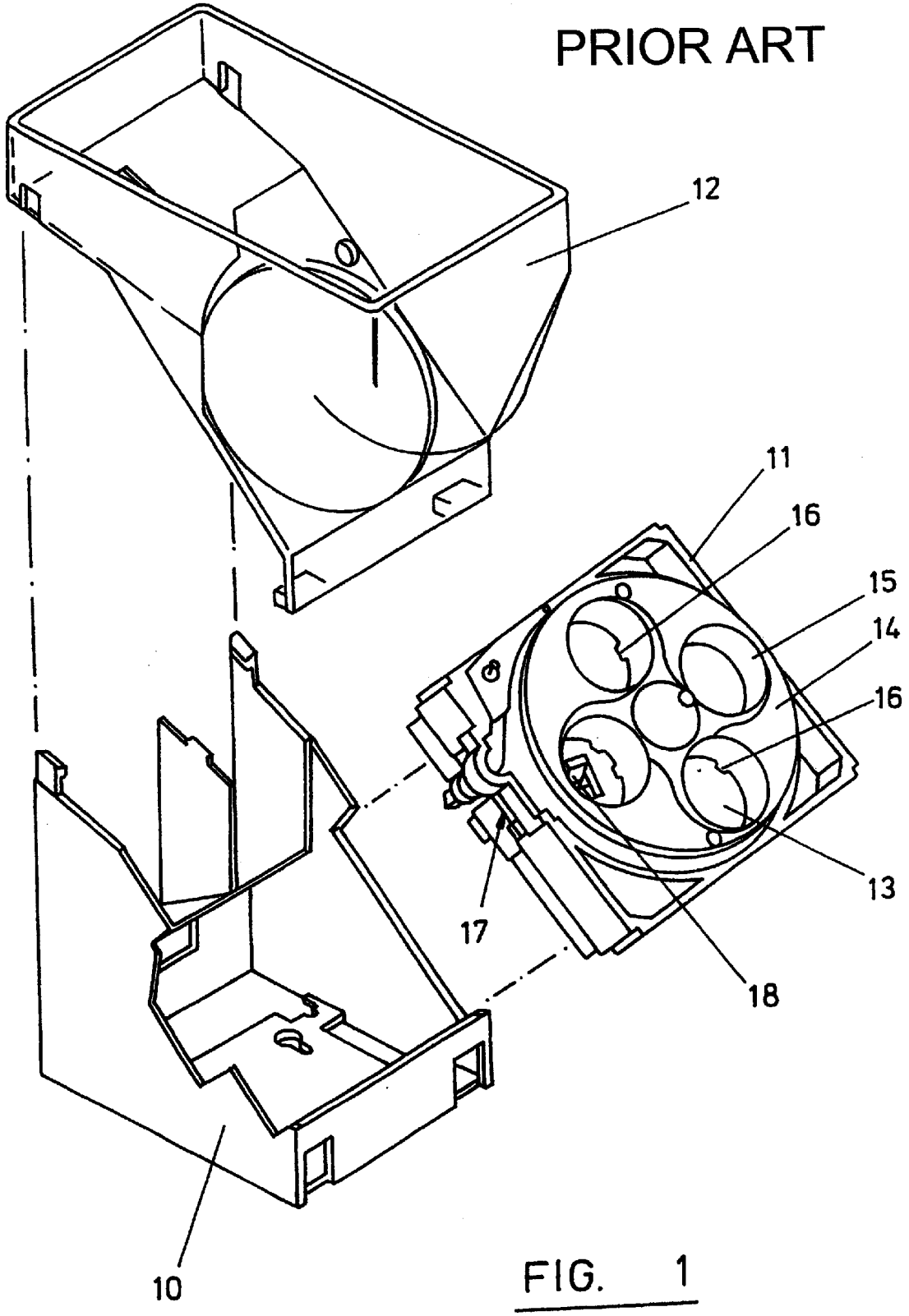
FIG. 1 is an exploded perspective view of a prior art compact hopper.
Figure 2:
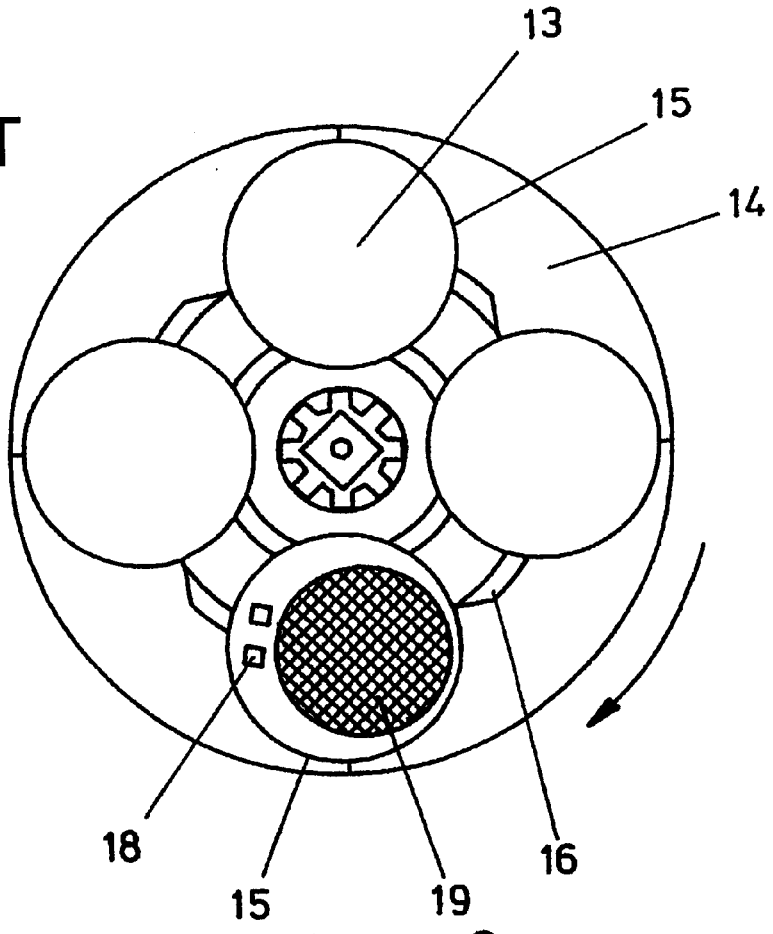
FIG. 2 is an underplan view of the disc of the prior art apparatus shown in FIG. 1.

The prior art apparatus shown in FIGS. 1 and 2 has already been described. It will be appreciated from a study of FIG. 2 that the coin which is in contact with the bed, shown as the shaded coin 19, lies substantially wholly within the associated hole 15, and therefore provides a good support for the coins stacked above it. However, the lowermost coin 19 is not particularly well controlled, and vibration could cause the coin to jump, which might cause the coin to jump or to ride over the fingers 18.

With the coin dispensing apparatus according to the invention, the pusher 16 (see FIG. 3) associated with the hole 15 is spaced well clear of the trailing edge of the hole 15, instead of being positioned at the edge of the trailing edge of the hole 15, as in the prior art apparatus shown in FIG. 2.

This means that as the lowermost coin 19 travels around the bed, being moved by the pusher 16, the coin lies substantially within the gap between the bed and the disc, and this provides a good degree of control over undesirable upward movement of the coin. Any movement of the leading edge of the coin is particularly well controlled.

Figure 5:
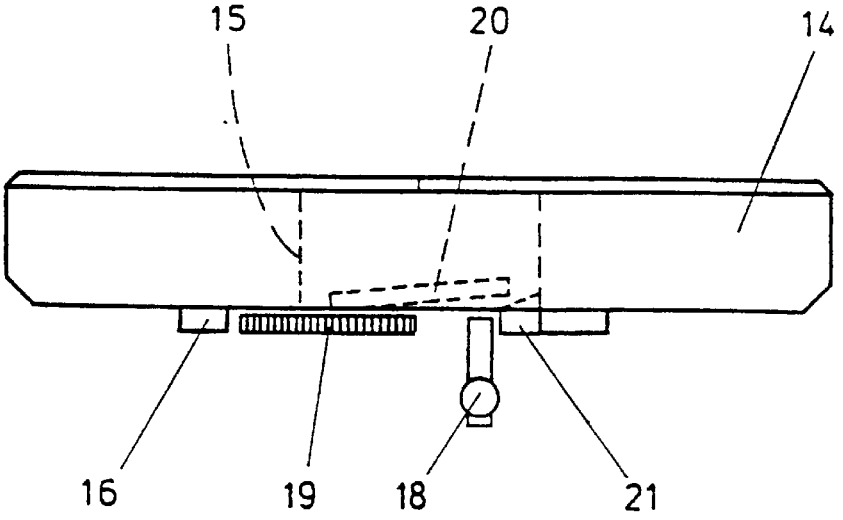
FIG. 5 is a side view of the disc shown in FIGS. 3 and 4.

Although this means that the coin 19 is well controlled, the coin 20 above (see FIG. 5) substantially overhangs the coin 19 and is not particularly well supported thereby. However, to prevent the coin 20 from tipping, thus causing a jam or causing the coin 20 to hit the fingers 18 first, a support ledge 21 is provided at the leading edge of the hole 15 and the leading edge of the coin 20 rests on this ledge.

Figure 4:
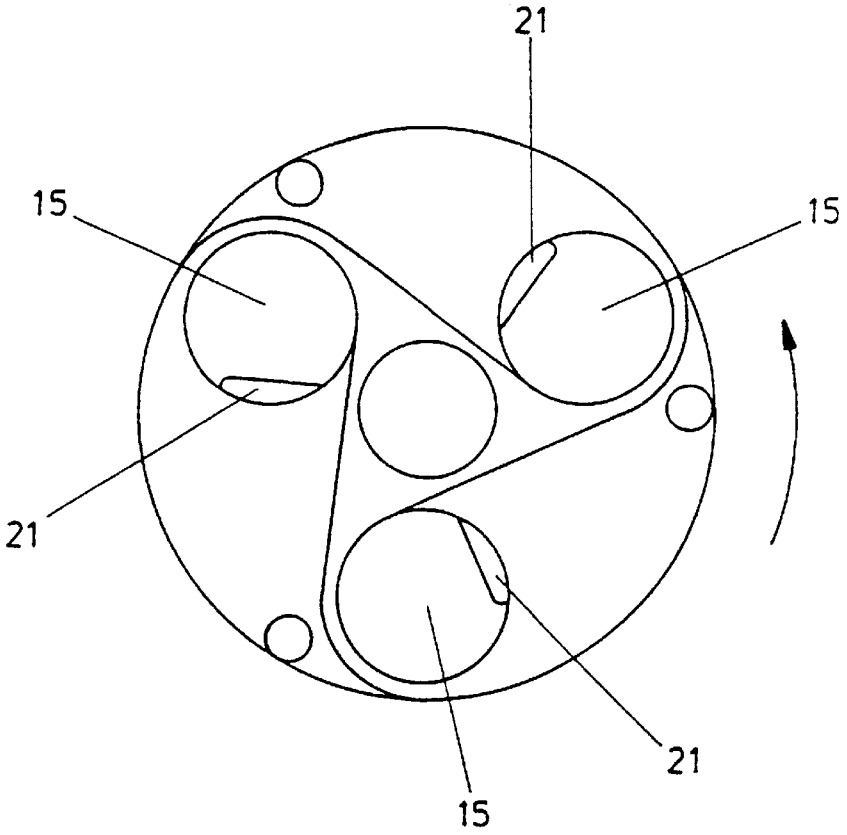
FIG. 4 is a plan view of the disc shown in FIG. 3.

The disc according to this embodiment has three holes 15 and as can be seen from FIG. 4, each hole is provided with its associated ledge 21.

Figure 3:
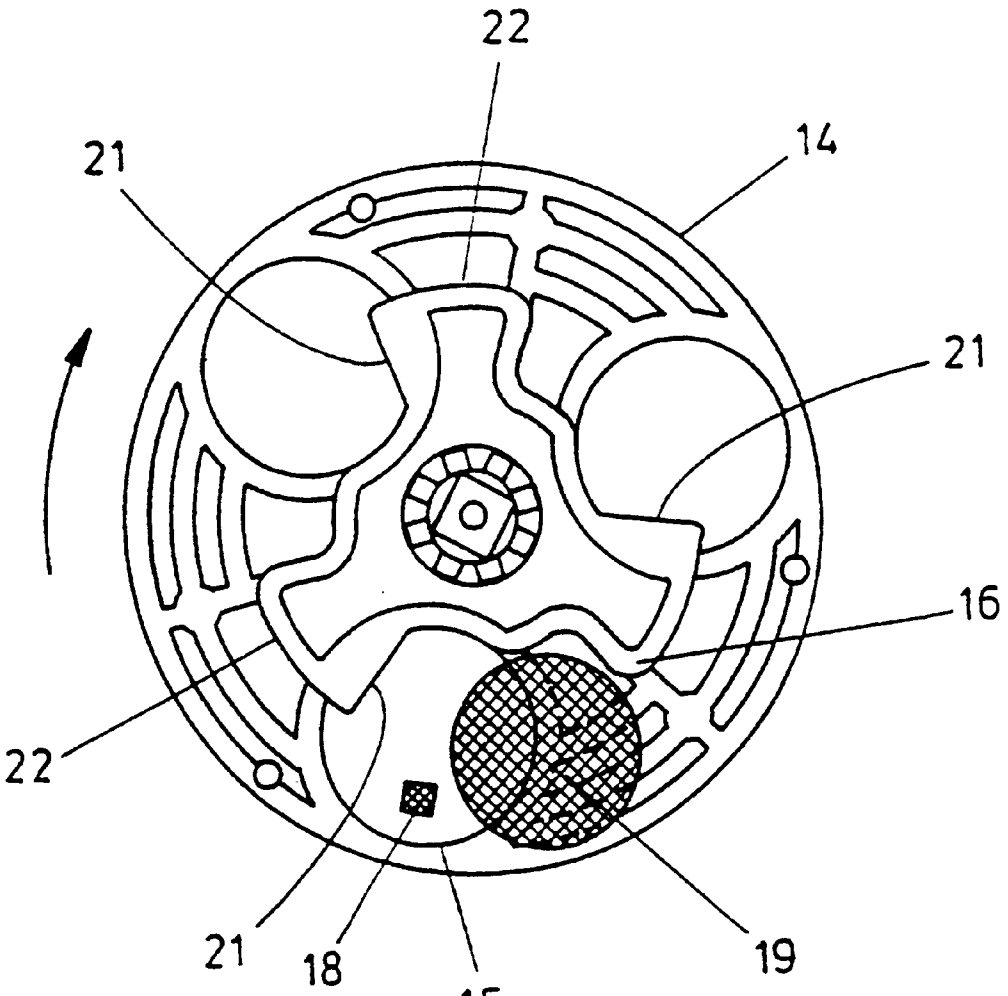
FIG. 3 is a view similar to FIG. 2, but showing the underside of a disc of an embodiment of coin dispensing apparatus according to the invention.
Figure 6:
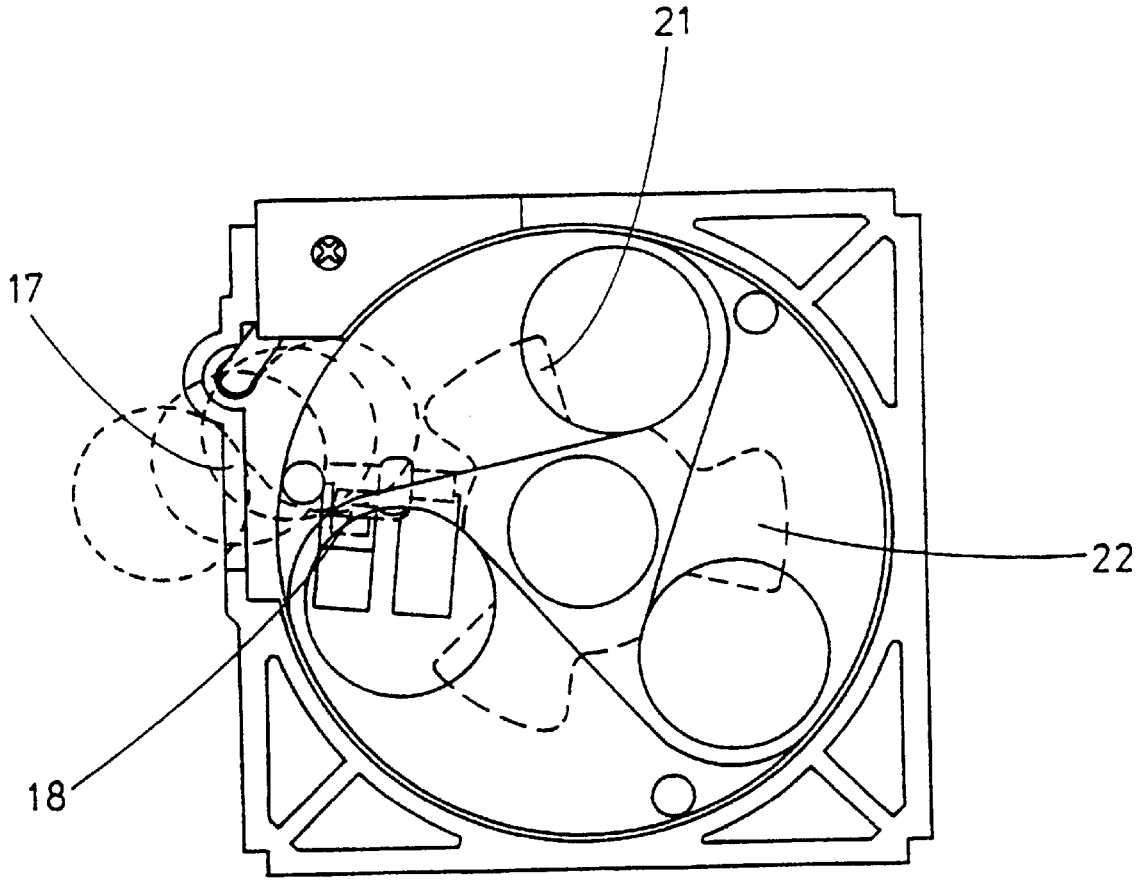
FIG. 6 is a plan view of the coin dispensing unit of the apparatus with the various stages of a coin being dispensed shown in dotted lines.

As can be seen from FIG. 3 and the plan view of the entire coin dispensing unit shown in FIG. 6, ledges 21 are provided by an intermediate member between the disc and the bed. This intermediate member has three lobes 22 and one edge of each lobe provides one of the ledges 21. The other edge of each lobe provides the pusher 16. The lobed member may comprise a separate component but it is preferred that it is an integral part of the rotor. An integral plastics moulding may be used.

FIG. 6 also illustrates how a coin is progressively dispensed from the unit.

As the lowermost coin is urged against the spring loaded finger 18 by the pusher, the fingers are gradually urged back against the action of its spring, storing energy.

Initially, the coin is not sufficiently in registration with the slot 17 to be able to pass out through the slot, but as more and more of the slot becomes visible to the coin, the coin progressively moves into the slot as shown by the dotted lines of FIG. 6. When the point is reached where the coin is fully in registration with the slot, the energy stored by the fingers causes the coin to flip out from the apparatus, as the fingers return to their starting position.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. Coin dispensing apparatus comprising a bed, a coin holder movable relative to the bed and spaced from the bed by a gap, the coin holder having at least one coin reservoir capable of holding a stack of at least two coins with the lowermost coin in contact with the bed, ejection means for ejecting the lowermost coin from the apparatus through the gap between the bed and the coin holder, means for pushing the lowermost coin over the bed towards the ejection means with the trailing portion of the lowermost coin lying within the gap such that the trailing portion of the lowermost coin is controlled by engagement with the facing surfaces of the bed and the coin holder, and support means, spaced from the ejection means, for preventing or restricting tilting of the coin above the lowermost coin, as the lowermost coin is ejected.

2. Coin dispensing apparatus as claimed in claim 1, provided with a coin pushing device on the coin holder which is appropriately spaced from the edge of the associated hole.

3. Coin dispensing apparatus as claimed in claim 1, in which the coin holder comprises a rotor which is rotatably mounted on the bed, the rotor having at least one hole therethrough, which hole acts as the coin reservoir.

4. Coin dispensing apparatus as claimed in claim 3, in which the support means to prevent or restrict tilting of the coin above the lowermost coin comprises a projection at the lower end of the hole.

5. Coin dispensing apparatus as claimed in claim 4, in which the projection comprises a ledge positioned to support the leading edge of the coin above the lowermost coin.

6. Coin dispensing apparatus as claimed in claim 3, in which the rotor comprises a disc.

7. Coin dispensing apparatus as claimed in claim 6, in which the disc has a plurality of coin supporting holes therein.

8. Coin dispensing apparatus as claimed in claim 7, in which a plurality of support ledges is provided, one associated with each hole, by providing an appropriately shaped member between the bed and the disc.

9. Coin dispensing apparatus as claimed in claim 8, in which the appropriately shaped member has a plurality of lobes.

10. Coin dispensing apparatus as claimed in claim 8, in which the appropriately shaped member is an integral part of the disc.

11. Coin dispensing apparatus as claimed in claim 1, provided with at least one spring loaded finger against which a coin to be dispensed can be squeezed by the coin pushing member.

* * * * *